US012674330B2

(12) United States Patent
Cruz Quiroga

(10) Patent No.: US 12,674,330 B2
(45) Date of Patent: Jul. 7, 2026

(54) HIGH-STRENGTH MODULAR FLOOR

(71) Applicant: INTERESTELAR X SPA, Santiago (CL)

(72) Inventor: Francisco Cruz Quiroga, Santiago (CL)

(73) Assignee: INTERESTELAR X SPA, Santiago (CL)

( * ) Notice: Subject to any disclaimer, the term of this patent is extended or adjusted under 35 U.S.C. 154(b) by 248 days.

(21) Appl. No.: 18/560,738

(22) PCT Filed: May 14, 2021

(86) PCT No.: PCT/CL2021/050038

§ 371 (c)(1),
(2) Date: Nov. 14, 2023

(87) PCT Pub. No.: WO2022/236435

PCT Pub. Date: Nov. 17, 2022

(65) Prior Publication Data

US 2024/0360681 A1 Oct. 31, 2024

(51) Int. Cl.

| | |
|---|---|
| ***E04F 15/02*** | (2006.01) |
| ***E01C 5/00*** | (2006.01) |
| ***E01C 5/20*** | (2006.01) |

(52) U.S. Cl.

CPC ..... *E04F 15/02022* (2013.01); *E01C 5/005* (2013.01); *E01C 5/20* (2013.01); *E04F 15/02183* (2013.01); *E04F 2201/05* (2013.01)

(58) Field of Classification Search

CPC ..... E04F 15/00; E04F 15/02022; E04F 15/02177; E04F 15/02183; E04F 2201/05; E01C 5/005; E01C 5/006; E01C 5/20

See application file for complete search history.

(56) References Cited

U.S. PATENT DOCUMENTS

| | | | | |
|---|---|---|---|---|
| 1,707,409 | A | 4/1929 | Nattkamper | |
| 3,572,224 | A | 3/1971 | Perry | |
| 6,860,074 | B2 * | 3/2005 | Stanchfield | E04F 19/065 52/592.1 |
| 6,878,881 | B1 * | 4/2005 | Henry | H02G 9/04 174/101 |
| 7,303,800 | B2 | 12/2007 | Rogers | |
| 7,546,707 | B1 * | 6/2009 | DiGennaro | E04F 15/082 404/34 |

(Continued)

FOREIGN PATENT DOCUMENTS

| | | |
|---|---|---|
| DE | 2512537 A1 | 9/1976 |
| WO | 9604441 A1 | 2/1996 |

OTHER PUBLICATIONS

International Search Report in PCT Application No. PCT/CL2021/050038 dated Dec. 21, 2021.

*Primary Examiner* — Chi Q Nguyen

(74) *Attorney, Agent, or Firm* — Dilworth IP, LLC

(57) ABSTRACT

A high-strength modular floor is presented, formed by two or more floor modules securely coupled together. The modular floor includes curved connectors for securing coupled floor modules together. The high-strength modular floor is versatile, can be adapted for different industrial and commercial uses, and is formed by high-strength floor modules securely coupled together by one or more curved connectors, which restrict relative movement between coupled floor modules along three Cartesian axes.

16 Claims, 13 Drawing Sheets

(56) References Cited

U.S. PATENT DOCUMENTS

| | | | | |
|---|---|---|---|---|
| 8,966,847 | B2 * | 3/2015 | Kessler | E04F 19/067 52/396.04 |
| 9,337,586 | B2 * | 5/2016 | McDowell | H01R 43/26 |
| 9,506,255 | B1 | 11/2016 | Jones et al. | |
| 10,156,045 | B2 | 12/2018 | Penland et al. | |
| 10,697,130 | B2 | 6/2020 | Jones et al. | |
| 11,761,214 | B2 * | 9/2023 | Thomas | E04F 15/02005 52/588.1 |
| 11,912,429 | B2 | 2/2024 | Toler | |
| 12,129,608 | B2 * | 10/2024 | Aziz | E01C 9/086 |
| 2009/0133349 | A1 * | 5/2009 | Sondermann | E04F 19/061 52/395 |
| 2009/0308014 | A1 * | 12/2009 | Muehlebach | E04F 15/02 52/592.4 |
| 2015/0007508 | A1 * | 1/2015 | Valtanen | E04B 5/48 52/302.1 |
| 2015/0152638 | A1 | 6/2015 | Hammond | |
| 2015/0233406 | A1 | 8/2015 | Leiseder | |
| 2015/0361675 | A1 * | 12/2015 | Cerny | E04F 15/105 52/509 |
| 2016/0102690 | A1 | 4/2016 | Hruschak | |
| 2016/0301161 | A1 * | 10/2016 | McDowell | E01C 5/005 |

* cited by examiner

HIGH-STRENGTH MODULAR FLOOR

TECHNICAL FIELD

The invention relates to a modular floor formed by two or more floor modules flexibly coupled and fastened to each other. Furthermore, the invention relates to floor modules and a curved connector for flexibly securing coupled floor modules together.

More particularly, the invention relates to a versatile and adjustable high-strength modular floor for various industrial and commercial uses, formed by high-strength floor modules flexibly coupled and fastened together by one or more curved connectors which restrict flexibly the relative movement between floor modules coupled in the three Cartesian axes.

BACKGROUND

In the field of construction of buildings or public or private spaces, modular floors are widely used as a constructive solution, both to temporarily improve the soil conditions at a working place and to provide a reusable floor that is simple to install and remove in temporary or permanent constructions. In most cases, modular floors seek to address challenges associated with installation complexity, installation/removal times, strength/durability, versatility of applications and environmentally friendly materials, among others.

Among the solutions proposed to address these challenges, the one exhibited in U.S. Pat. No. 10,156,045B2 stands out, which presents a low-weight and reusable floor panel or cover system lighter than wooden floors and that can be placed in and removed from a working place quickly and easily. The panels that make up the solution in U.S. Pat. No. 10,156,045B2 seek to offer high durability, being preferably manufactured by molding plastic materials which may or may not be recycled. In this context, the solution in U.S. Pat. No. 10,156,045B2 proposes the joining of modular panels using rotating connectors arranged on the periphery of the panels in an overlapping area between adjacent panels. This joining solution between panels widely used in existing commercial solutions is simple and quick to operate, but it does not provide sufficient strength to the different stresses to which the panels are subjected during high-demand applications, such as support of heavy machinery or the construction of storage warehouses. Furthermore, said solution considerably reduces the flexibility of the floors completely preventing relative movements between adjacent panels.

Indeed, the rotating connector used in U.S. Pat. No. 10,156,045B2 offers greater strength to lateral stresses, for example, which occur due to the traffic of machinery, but its strength to vertical forces is lower, particularly in high tonnage applications. Furthermore, the strength to lateral forces is limited by the mechanical capabilities of the rotating connector, which removable, pressure fit nature and reduced diameter considerably weaken not only its tensile strength impairing the vertical strength, but also its strength to shear stresses limiting its lateral strength. On the other hand, the configuration of the connector prevents the transmission of any torsional stress on the floor, stiffening the connection between panels and preventing angular flexibility between them.

The same problems occur with the solutions exhibited in U.S. Pat. No. 7,303,800B2 and U.S. Pat. No. 9,506,255B1 which use joining systems between similar panels using rotating connectors arranged in the perimeter. In these cases, the strength seeks to be improved through more robust connectors as in U.S. Pat. No. 7,303,800B2, or by increasing the number of connectors between panels as in U.S. Pat. No. 9,506,255B1. However, these solutions only improve the lateral and vertical strength increasing the costs of the solution with a lower contribution to the vertical strength, which remains focused on the adjustment characteristics of the rotating connector and no contribution to the flexibility of the union between panels.

On the other hand, U.S. Pat. No. 10,697,130B2 provides a solution where a joining system between panels is combined using a rotating connector similar to the previous cases but using a more complex solution with wedge areas between panels. In this case, the combination of the joining systems using connectors and wedge areas increases the lateral strength of the floor particularly as a result of the shape characteristics of the wedge between panels. However, said fit between panels generates a lower contribution to the strength to vertical forces and no contribution to flexibility, so the solution in U.S. Pat. No. 10,697,130B2 not only presents difficulties associated with a lower vertical strength, but also restricts the flexibility of the union between panels.

In view of the above, there is a need for a modular floor that not only addresses the challenges that most modular floors face associated with simplicity of operation, installation/removal processes and time, durability and use of environmentally friendly materials, but at the same time offers high performance in terms of strength to lateral and vertical forces generating a floor with a flexible union between floor modules, being useful for applications with high mechanical demand and with sufficient resilience to resist torsional stress and adapt to terrain irregularities.

In this context, the invention seeks to be an alternative to current solutions focusing on offering a modular floor with the following characteristics, high strength to load and torsion; easy configuration and assembly; with different coupling or hooking structures between floor modules; that allows expansion due to the effects of heat; suitable for being manufactured using different plastic materials, providing different mechanical properties (flexion, torsion, traction, shear, etc.); that can be manufactured at low cost and in series; efficient in storage and transportation; recyclable; and suitable for using a diverse number of recycled materials sources in its manufacturing.

Having said the above, the invention is described below in relation to its essential characteristics, preferred embodiments and technical problems that are sought to solve in comparison with similar solutions.

DESCRIPTION OF THE INVENTION

The invention relates to a modular floor formed by two or more floor modules flexibly coupled and fastened to each other. Furthermore, the invention relates to floor modules and a curved connector for flexibly securing coupled floor modules together.

The floor modules of the invention are connected to each other by means of an overlapping system, that is, a system where the body of a floor module overlaps and joins with part of the body of an adjacent floor module generating a common structure. The use of the overlapping system allows generating large sections of floor modules joined together which not only behave as a single high-strength structure distributing the loads between modules, but at the same time behave as a flexible structure allowing them to settle in uneven terrain and in the expansions inherent to the material and temperature changes.

In this context, one of the main objectives of the invention is to generate a modular floor in which the floor modules are joined or connected to each other in a secure but flexible manner, that is, that simultaneously:

restrict relative movement between coupled floor modules in the three Cartesian axes (x, y, z) to avoid relative displacements between said modules, and provide flexibility to the joint between coupled floor modules allowing relative angular movement between said modules, so that the joint can adjust and adapt without breaking or releasing.

Particularly, the invention relates to a curved connector for flexibly securing coupled floor modules together. According to the preferred embodiment, the curved connector is formed by a single-piece body that comprises a perimeter curved portion and a central curved portion. Between said perimeter curved portion and said central curved portion there is at least one passage that has curved walls formed by the perimeter curved and central curved portions. Furthermore, said passage has an inlet end and a locking end, wherein said locking end comprises a locking mechanism. That is, the locking mechanism is located inside the at least one passage of the curved connector. According to one embodiment, the curved connector is symmetrical in a transverse plane presenting two passages, one on each side of said plane.

When the floor modules are coupled the at least one passage of the curved connector is configured to receive therein an upper curved surface coupled to a lower curved surface of coupled floor modules. In this configuration, the curved walls of the passage flexibly constrain a relative movement between the coupled floor modules in the three Cartesian axes. In this regard, to flexibly restrict said relative movement in the three Cartesian axes, the curved connector blocks the coupling between upper and lower curved surfaces by means of a rotation movement of this through a curved connector slot that said upper and lower curved surfaces have. In this way, the at least one passage of the curved connector receives said coupled upper and lower curved surfaces which enter to the at least one passage from the inlet end and slide through said at least one passage to the locking end. Thereby, the locking mechanism is activated at the locking end of the passage locking the curved connector in a flexible locking position of the curved connector in which the at least one passage comprises a locking space that allows relative sliding between the coupled upper and lower curved surfaces locking the curved connector in the flexible locking position of the curved connector and flexibly securing the coupled floor modules to each other.

The locking space comprising the at least one passage of the curved connector towards its locking end, in the flexible locking position of the curved connector, is a portion of the passage that allows relative sliding between floor modules once it has been activated the locking mechanism. Said locking space provides the necessary flexibility to the union between coupled floor modules allowing angular movement between said modules but maintaining the restriction on relative displacement between them.

Preferably, the invention also relates to a floor module for forming a modular floor of two or more coupled floor modules flexibly fastened to each other. The floor module is formed by a single-piece body that comprises a lower portion and an upper portion, wherein the upper and lower portions are arranged relative to each other generating perimeter overlapping areas. In this way, a lower perimeter overlapping area is arranged in the lower portion of the body and an upper perimeter overlapping area is arranged in the upper portion of the body, wherein the upper overlapping area comprises at least one upper curved surface and the lower overlapping area comprises at least one lower curved surface, said at least one upper curved surface and at least one upper curved surface comprising a curved connector slot.

When the floor modules are coupled, the at least one upper curved surface is configured to couple to the at least one lower curved surface of the coupled floor modules and through the curved connector defined above, the relative movement between the coupled floor modules is flexibly constrained in the three Cartesian axes generating a flexible coupling between the coupled floor modules. As highlighted, said curved connector blocks the coupling between upper and lower curved surfaces by means of a rotation movement thereof through the curved connector slot, so that the at least one passage of the curved connector receives said upper and lower curved surfaces which enter to the at least one passage from the inlet end and slide through said at least one passage to the locking end. This activates the locking mechanism of the curved connector, locking the curved connector in a flexible locking position of the curved connector and flexibly securing the coupled floor modules to each other.

Finally, according to the preferred embodiment, the invention also refers to a modular floor formed by two or more coupled floor modules flexibly fastened to each other, characterized in that it comprises:

at least one curved connector as defined above; and two or more floor modules as defined above.

In this context, at least part of the upper perimeter overlapping area of a first floor module is coupled to at least part of the lower perimeter overlapping area of a second floor module, so that at least one upper curved surface of the first floor module is coupled with at least one lower curved surface of the second floor module. With this, the coupling of the first floor module with the second floor module is achieved.

When the first floor module is coupled to the second floor module, the coupling between the at least one upper curved surface and the at least one lower curved surface is locked by a rotational movement of the curved connector through a curved connector slot that said upper and lower curved surfaces have. Thereby, the at least one passage of the curved connector receives said coupled upper and lower curved surfaces which enter the at least one passage from the inlet end and slide through said at least one passage to the locking end. This activates the locking mechanism locking the curved connector in a flexible curved connector locking position and flexibly securing the coupled floor modules together.

According to one embodiment, the locking mechanism of the curved connector comprises a locking flange and a locking notch inside the at least one passage at its locking end. Said locking notch is configured to receive, by pressure fit, a locking projection arranged on the upper curved surface of a floor module locking the curved connector in its flexible locking position by said pressure fit. This activates the locking mechanism. As indicated, the activation of the locking mechanism allows relative angular movement between coupled floor modules, thanks to the locking space that the at least one passage of the curved connector has.

According to another embodiment, the at least one passage of the curved connector may comprise a fixing mechanism arranged at its inlet end. Said fixing mechanism is configured to contact at least one of the coupled floor modules in the locking position of the curved connector, and to receive a releasable fixing element that releasably fixes the curved connector to the at least one of the floor modules.

According to another embodiment, the central curved portion of the curved connector may comprise a flat surface comprising at least one unlocking notch. The unlocking notch is configured to receive an unlocking tool that allows the locking mechanism to be deactivated by a rotational movement of the curved connector towards an unlocking position of the curved connector. The primary objective of the release notch is to facilitate the application of the force necessary to disengage the locking mechanism activated by a pressure fit during the securing of the modules with the curved connector.

On the other hand, according to another embodiment, each floor module may comprise at least four lower curved surfaces in the lower perimeter overlapping area and at least four upper curved surfaces in the upper perimeter overlapping area for the arrangement of at least two curved connectors for each edge of a module.

Furthermore, each floor module may comprise at least one lower support surface in the lower perimeter overlapping area and at least one upper support surface in the upper perimeter overlapping area. Then, when the floor modules are coupled, said lower and upper support surfaces of the coupled floor modules contact each other generating at least one support area. Alternatively, the lower and upper support surfaces may comprise at least one fixing hole for fixing the coupled floor modules by means of a fixing element fixing said coupled floor modules together in the support area.

According to another embodiment, each floor module may comprise at least one fitting hole in the lower perimeter overlapping area and at least one fitting projection in the upper perimeter overlapping area. Then, when the floor modules are coupled, the at least one fitting hole is configured to receive the at least one fitting projection of the coupled floor modules. Alternatively, the at least one fitting projection in the upper perimeter overlapping area is hollow and is configured to receive a stake that allows attachment of the coupled floor modules to the ground.

According to another embodiment, each floor module may comprise at least one lower locking hole in the lower perimeter overlapping area and at least one upper locking hole in the upper perimeter overlapping area. Then, when the floor modules are coupled, the at least one lower locking hole aligns with the at least one upper locking hole of the coupled floor modules. Thereby, said lower and upper locking holes are configured to receive a rotating connector which when inserted into the lower and upper locking holes and rotated to a locking position of the rotating connector, restricts relative vertical movement between coupled floor modules. Alternatively, the lower locking hole comprises a lower unlocking section and a lower locking section, wherein the lower locking section makes pressure contact with a locking element in the rotating connector to lock relative vertical movement between the coupled floor modules in the locking position of the rotating connector. Furthermore, the upper locking hole comprises, in the rotation direction of the rotating connector:

- an insertion section for insertion of the rotating connector into the upper locking hole;
- an upper locking section which fits with the lower locking section and with the locking position of the rotating connector, wherein the upper locking section further prevents return of the rotating connector to the insertion section permanently joining the rotating connector with the upper locking hole;
- a transition section through which the pressure contact between the locking element of the rotating connector and the lower locking section is gradually released; and
- an upper unlocking section which fits with the lower unlocking section in which the coupled floor modules can be decoupled.

The movement of the rotating connector between the upper locking section, the transition section and the upper unlocking section can be performed in a locking direction and in an unlocking direction by means of pressure fit mechanisms located between said sections. The rotating connector comprises at least one pressure fit projection cooperating with pressure fit flanges and notches in the upper locking hole. Additionally, an upper end of the rotating connector may comprise a notch or slot to facilitate rotation of the rotating connector by a user.

On the other hand, each floor module may comprise a cover that connects to the lower face of the lower portion of the floor module body, wherein said cover comprises a cover grid that fits with a module grid arranged on the lower face of said lower portion of the floor module configuring a reinforced grid. The cover comprises a slotted lower face for contact with the ground, and both the cover and the lower face comprise at least one perforation to receive a fixing element that fixes the cover to the body of the floor module.

Finally, according to one embodiment of the invention, the modular floor may comprise perimeter ramp sections, wherein said perimeter ramp sections comprise:

- a ramp lower overlapping area configured to couple with the upper perimeter overlapping area of a floor module; or
- a ramp upper overlapping area configured to couple with the lower perimeter overlapping area of a floor module.

Furthermore, the modular floor may comprise corner sections which are part of corner perimeter ramp sections comprising a single-piece body, or corner sections that are independent of the perimeter ramp sections.

Based on the above, the invention may comprise different coupling or union structures between floor modules, each coupling structure arranged in the upper and lower overlapping areas of each module. These coupling structures can be summarized as:

- curved coupling structure formed by the union of at least one curved connector with the respective upper and lower curved surfaces of coupled modules, wherein said curved connector locks the upper and lower curved surfaces of coupled modules in a curved connector locking position, restricting relative displacement between modules flexibly allowing angular movement between modules.
- support coupling structure formed by the coupling between coupled upper and lower support surfaces one on top of the other.
- fitting coupling structure formed by the coupling between at least one fitting hole and at least one fitting projection.
- rotating coupling structure formed by the union of at least one rotating connector with the respective upper and lower block holes, wherein said rotating connector blocks the relative vertical movement between modules in a rotating connector locking position.

Greater details of the invention including the different coupling structures between modules, can be seen in relation to the accompanying Figures.

BRIEF DESCRIPTION OF THE FIGURES

As part of the present invention, the following representative Figures are exhibited which show preferred embodiments of the invention and, therefore, should not be considered as limitations to the definition of the claimed subject matter.

DETAILED DESCRIPTION OF A PREFERRED EMBODIMENT

Figure 1:
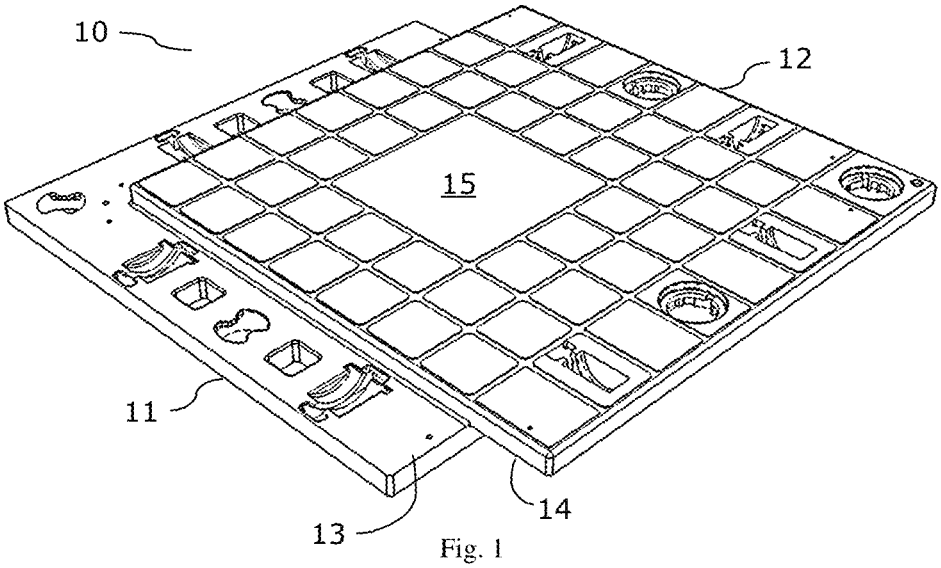
FIG. 1 shows a top perspective view of a floor module according to a preferred embodiment of the invention.

FIG. 1 shows a perspective view of a floor module (10) according to a preferred embodiment of the invention. In said Figure it is possible to appreciate that the floor module (10) is formed from a single piece body which comprises a lower portion (11) and an upper portion (12), said upper and lower portions arranged out of phase with each other to generate a lower perimeter overlapping area (13) and an upper perimeter overlapping area (14). According to one embodiment, the single-piece body that forms the floor module (10) is made of plastic material, preferably recycled plastic, and is formed by injection molding.

In FIG. 1 the arrangement of the curved, support, fitting and rotating coupling structures arranged in the lower and upper perimeter overlapping areas (13, 14) of the floor module (10) can be seen. Furthermore, in FIG. 1 it can be seen that the upper surface (12) of the floor module may comprise a square slotted and may have one or more larger smooth areas (15) which may be useful for the presentation of a commercial logo or text, for example, an embossed logo by injection molding along with the module body, by in-mold labeling during the injection process, or a label type logo adhered to the surface.

Figure 2A:
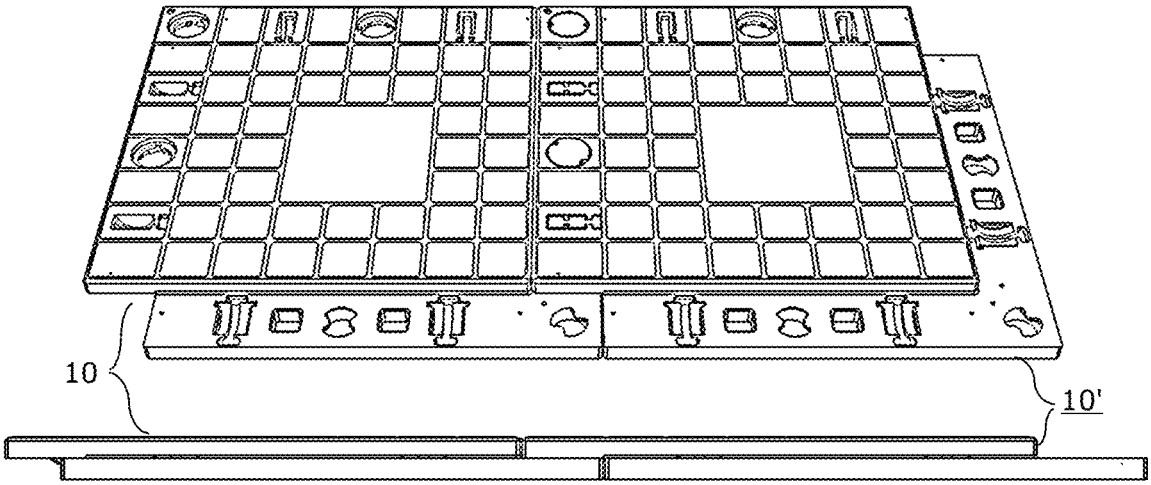
FIG. 2*a* and FIG. 2*b* show side and perspective views of the connection between floor modules according to a preferred embodiment of the invention.
Figure 2B:
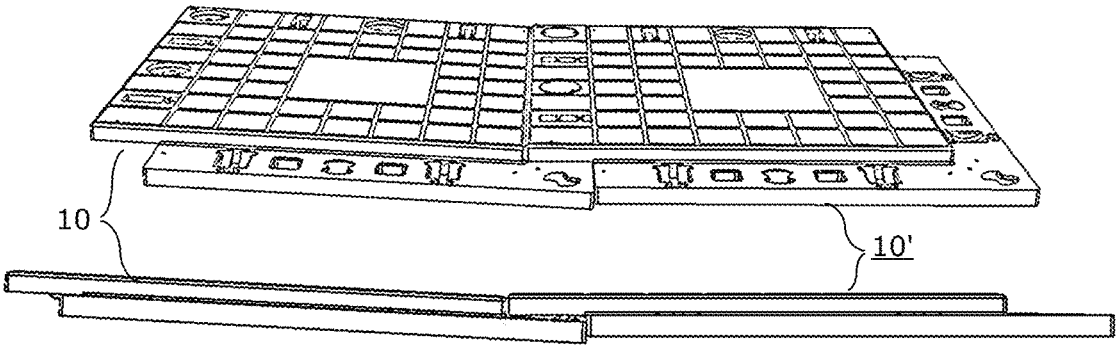

On the other hand, FIG. 2*a* and FIG. 2*b* show side and perspective views of two adjacent floor modules (10, 10') coupled together. In FIG. 2*a* it can be seen that the coupled modules (10, 10') are arranged joined by the coupling structures in the upper and lower overlapping areas forming a straight overlapping joint. On the other hand, in FIG. 2*b* it can be seen that said union through the coupling structures in the upper and lower overlapping areas can form an articulated union, thanks to the flexible securing proposed by the invention. As it has been highlighted, an articulated joint, or one that allows relative angular movement between coupled floor modules provides high resilience to the modular floor which is capable of better adapting to the irregularities of the terrain avoiding or at least reducing stresses or loads that said irregularities exert on the joint between modules during the installation and operation of the modular floor.

Figure 3A:
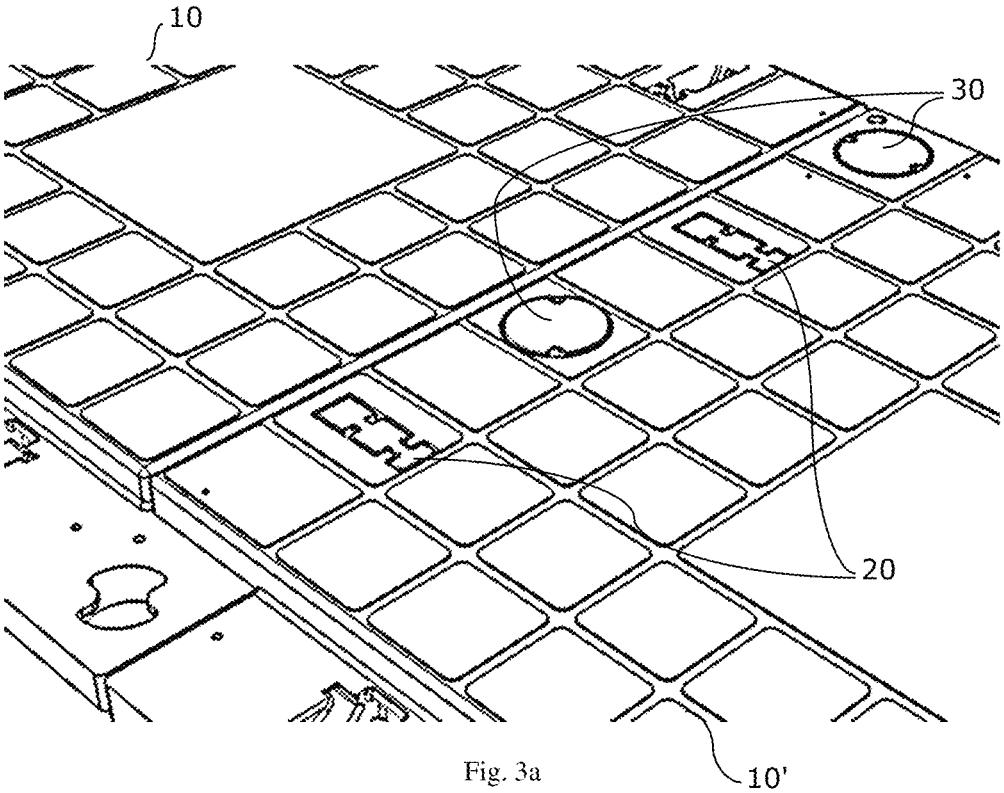
FIG. 3*a* shows a perspective view of the arrangement of curved and rotating connectors in the overlapping area between floor modules, according to a preferred embodiment of the invention.
Figure 3B:
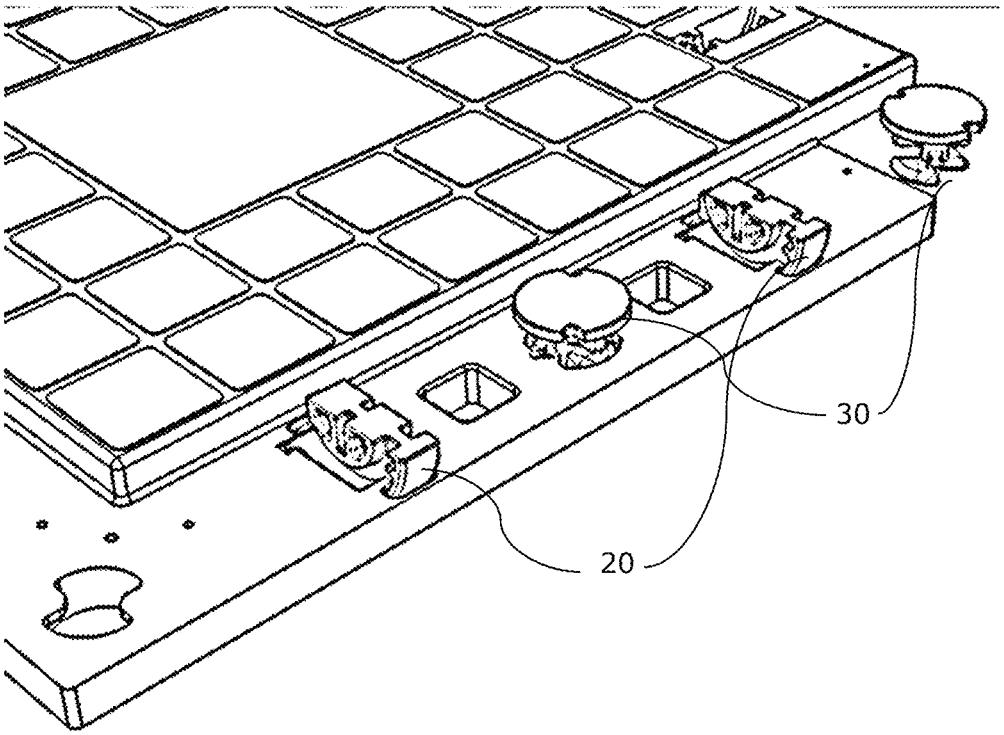
FIG. 3*b* shows a perspective view of the arrangement of curved and rotating connectors in the overlapping area between floor modules of FIG. 3*a*, eliminating one floor module to highlight the curved and rotating connectors.

FIG. 3*a* shows a representative diagram of the overlapping area between modules, highlighting the arrangement of curved connectors (20) and rotating connectors (30) in said overlapping area. Indeed, FIG. 3*a* shows two curved connectors (20) and two rotating connectors (30) arranged in the same overlapping area to ensure coupling between adjacent floor modules (10, 10') by means of the curved coupling structures and rotary coupling. Furthermore, in less detail the support and fitting coupling structures can be seen, which also ensure the coupling between modules. Likewise, FIG. 3*b* shows in greater detail the two curved connectors (20) and the two rotating connectors (30), eliminating one of the floor modules from the representation. In this context, the characteristics of the different coupling structures exhibited by the invention are presented in detail below.

Curved Coupling Structure

FIGS. 4*a-g* show the preferred characteristics of the curved coupling structure that comprises the invention formed by a curved connector (20) that interacts with a lower curved surface (16) and an upper curved surface (17) of coupled floor modules. This coupling structure characterized by the curved connector (20) corresponds to the preferred coupling mechanism of the invention, allowing the coupling between modules of a modular floor to be flexibly fastened. In effect, the curved connector (20) upon coming into contact with the coupled lower and upper curved surfaces (16, 17) is capable of restricting the relative movement between the floor modules in the three Cartesian axes providing flexibility to said restriction of movement by allowing angular movement between modules and by distributing bending stresses throughout the contact surface of the curved connector (20) with the lower and upper curved surfaces (16, 17). In this sense, the curved connector generates a hinge type joint between modules that in small variations, is capable of absorbing bending and torsional stresses between adjacent modules while keeping the relative displacement between said modules restricted.

Figure 4A:
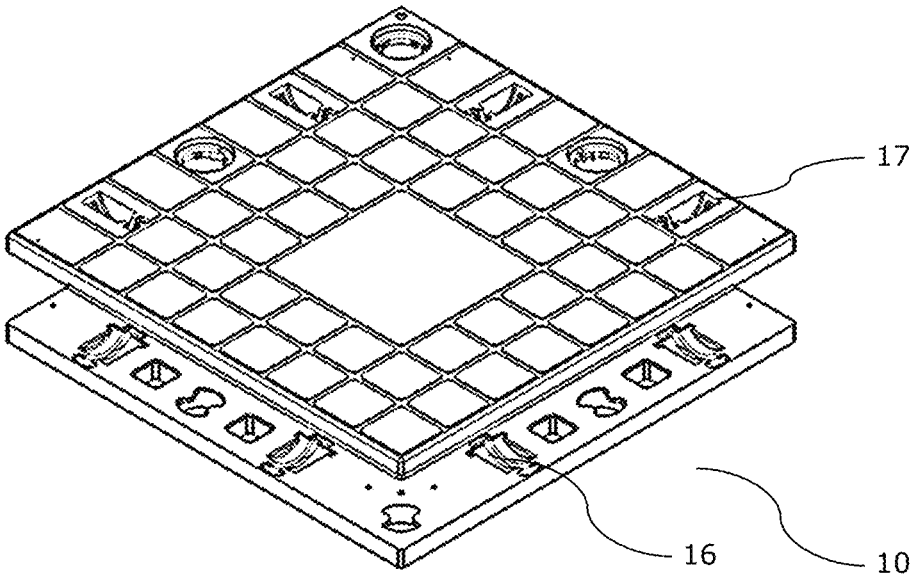
FIG. 4*a* shows a perspective view of a floor module according to a preferred embodiment of the invention highlighting the upper and lower curved surfaces.
Figure 4B:
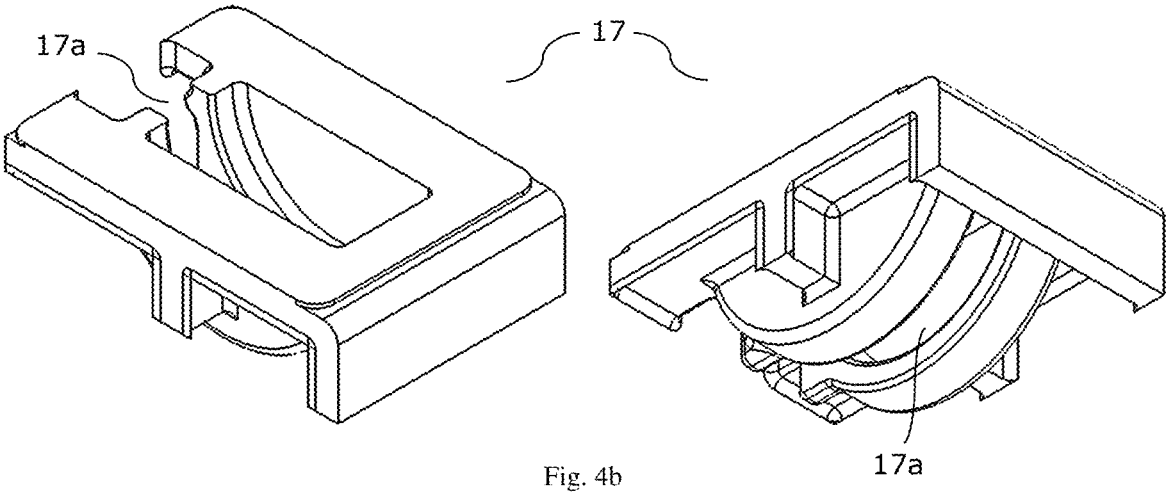
FIG. 4*b* shows top and bottom perspective views of the upper curved surface according to one embodiment of the invention.
Figure 4C:
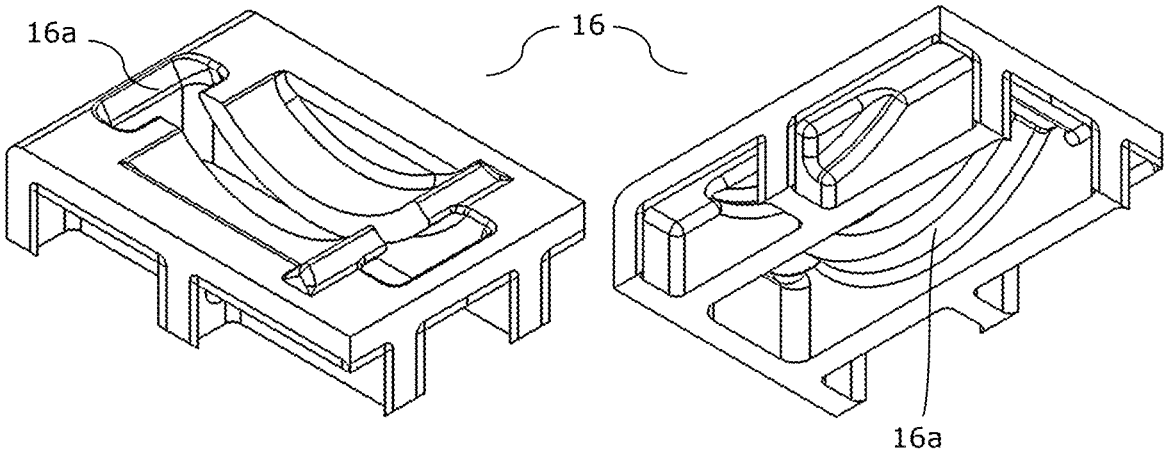
FIG. 4*c* shows top and bottom perspective views of the lower curved surface according to one embodiment of the invention.
Figure 4D:
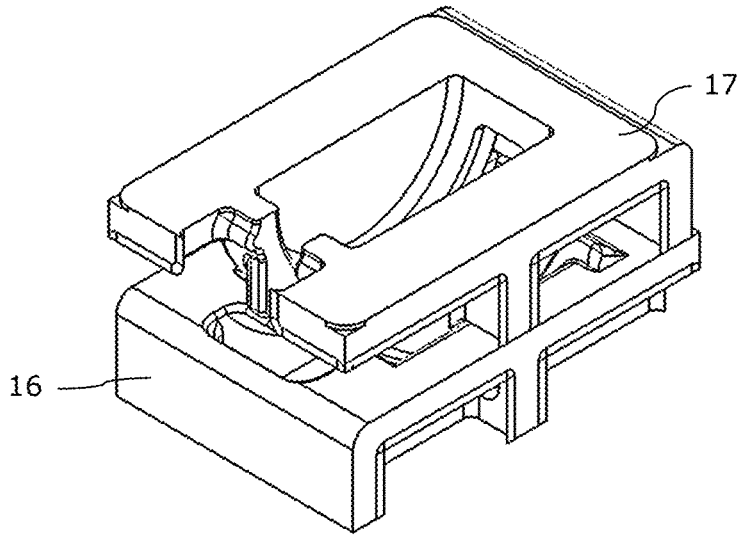
FIG. 4*d* shows a perspective view of the upper and lower curved surfaces coupled together, according to one embodiment of the invention.

In FIG. 4*a*, a floor module can be seen in accordance with a preferred embodiment of the invention, where preferred locations of the curved coupling structures are highlighted, in this case, the lower and upper curved surfaces (16, 17). As it is possible to appreciate, said curved surfaces are arranged in the overlapping areas of the module and preferably they are configured equidistant and uniform in said overlapping areas, facilitating a uniform distribution of the load. In FIG. 4*b*, perspective views of the upper curved surface (17) of a floor module can be seen, highlighting the curved connector slot (17*a*) that is centrally arranged on said upper curved surface (17). Equivalently, in FIG. 4*c* there are perspective views of the lower curved surface (16) of a floor module, highlighting the curved connector slot (16*a*) also centrally arranged. As shown, the curvature and components of the upper and lower curved surfaces fit in a complementary manner facilitating a coupling between adjacent floor modules. Said coupling between curved surfaces is shown schematically in FIG. 4*d*.

Figure 4E:
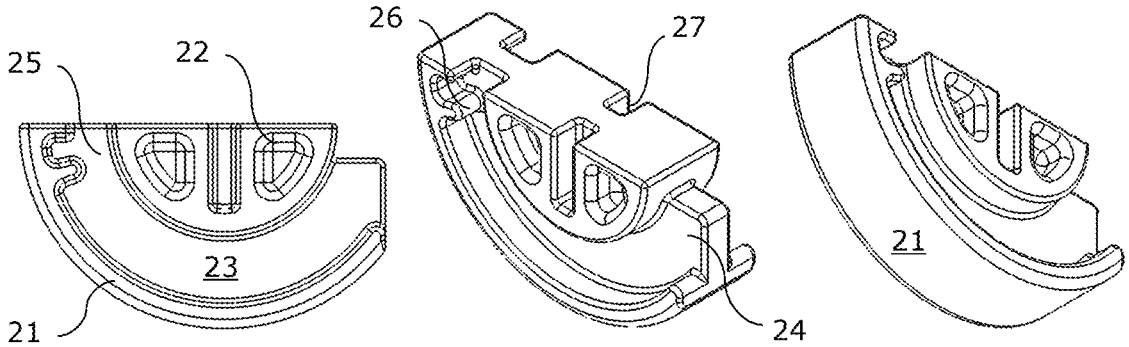
FIG. 4*e* shows side and perspective views of the curved connector according to a preferred embodiment of the invention.

On the other hand, FIG. 4*e* shows detailed views of the curved connector (20) according to the preferred embodiment being possible to see that it comprises a perimeter curved portion (21) and a central curved portion (22), wherein between the perimeter curved portion (21) and the central curved portion (22), at least one passage (23) is arranged which has curved walls formed by the perimeter curved and central curved portions (21, 22). Said passage (23) comprising an inlet end (24) and a locking end (25), where the locking end has a locking mechanism (26). Preferably, the structure of the curved connector is symmetrical in its longitudinal axis comprising two passages, one on each side of the connector. Furthermore, in FIG. 4*e* it is possible to see the unlocking notch (27) that the curved connector may comprise in its central curved portion (22) especially on the flat surface of said portion.

Figure 4F:
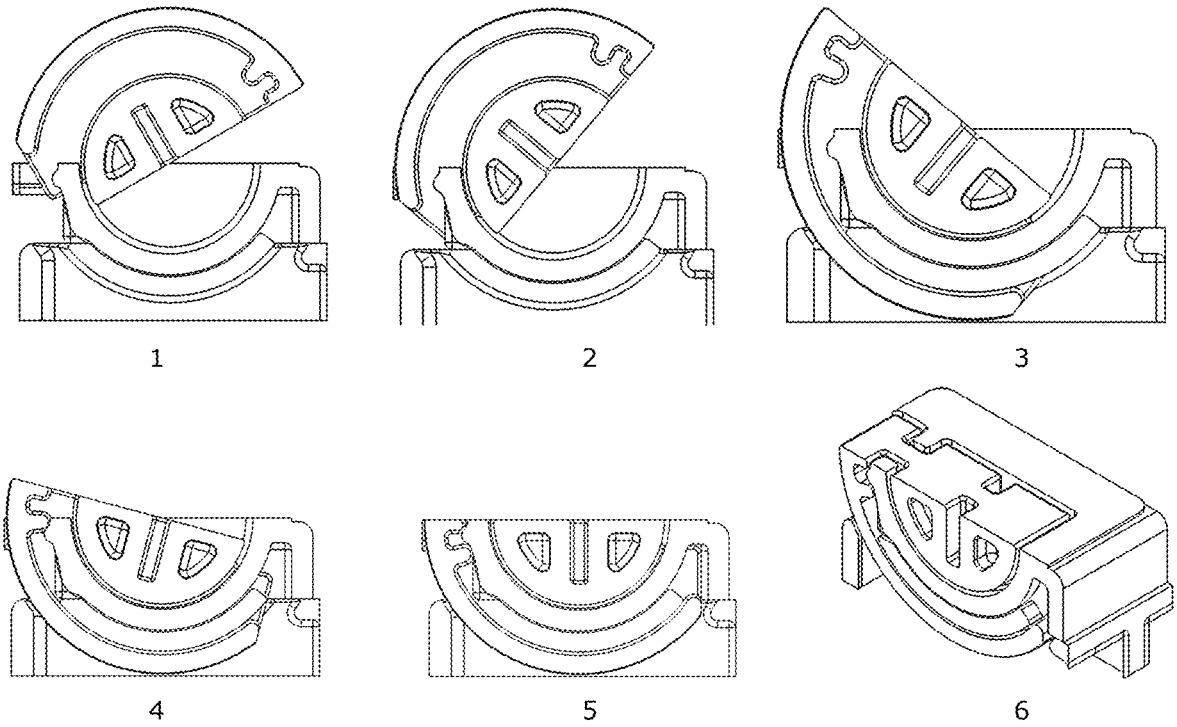
FIG. 4*f* shows a representative diagram of the rotation movement of the curved connector during its installation to block the coupling between upper and lower curved surfaces, according to a preferred embodiment of the invention.

In FIG. 4*f* it is possible to appreciate the rotation movement by which the curved connector receives the coupled upper and lower curved surfaces, and by which the locking mechanism is activated when said surfaces are at the locking end of the curved connector passage. In fact, through stages 1 to 5 shown in FIG. 4*f* it is evident how the rotation movement of the connector ensures the coupling between the upper and lower curved surfaces activating the locking mechanism in stage 5 after overcoming a pressure fit force between stage 4 and 5. Stage 6 shows a perspective view of stage 5 with the curved connector in its locked position. In the same way, the curved connector can rotate in reverse from stage 5 to stage 1 unlocking the coupling between upper and lower curved surfaces. Preferably, for said unlocking, an unlocking tool is used which is inserted into the unlocking notches of the curved connector facilitating the application of a torque that exerts the necessary force to overcome the pressure fit force of the locking mechanism, deactivating it.

Figure 4G:
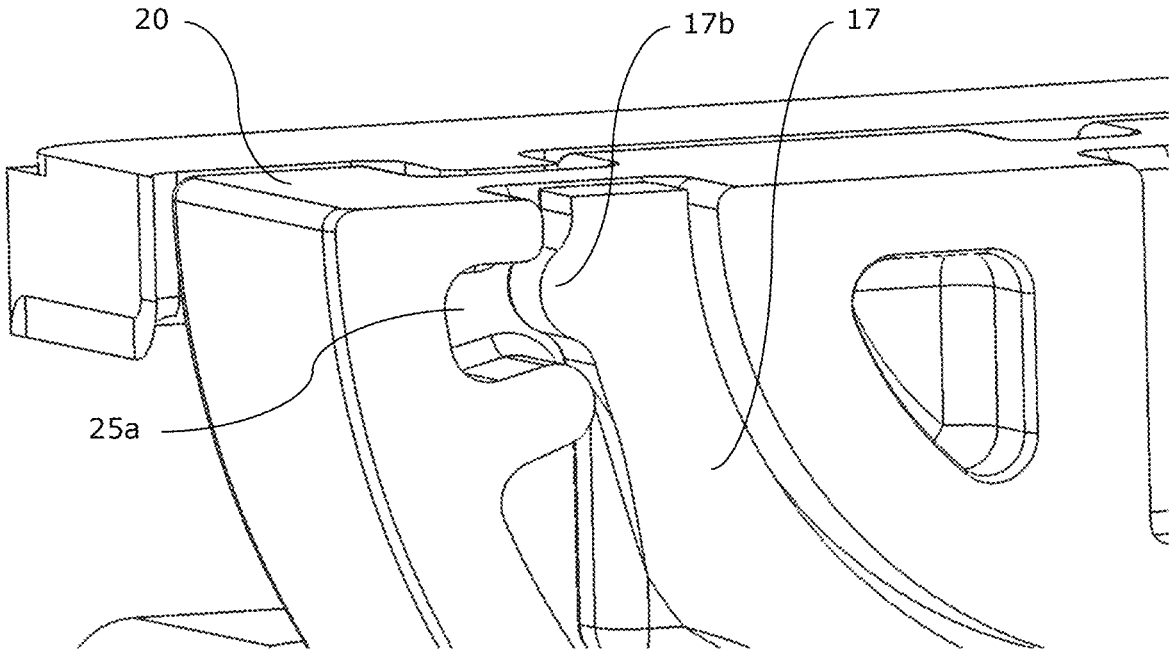
FIG. 4*g* shows a detail of the locking mechanism that the curved connector and the upper curved surface have, in the locking position of the curved connector.

Finally, FIG. 4*g* shows a detail of the configuration between the curved connector (20) and the upper curved surface (17) in the locking position of the curved connector, being possible to see in detail the locking notch (25*a*) that the passage of said curved connector (20) has, and the blocking projection (17*b*) that said upper curved surface of a floor module has. In fact, it is possible to see that the locking notch (25*a*) is preferably generated from one of the walls of the curved connector (20) passage facing the locking projection (17*b*) that the upper curved surface (17) has on its lower face. Furthermore, it is possible to see that the configuration of the notch and locking projection (25*a*, 25*b*) makes the locking generated by the curved connector more flexible allowing relative angular movements between coupled floor modules. As an example, enlarging the size of the locking notch (25*a*) provides greater angular movement space to the locking projection (17*b*) and, thereby, increases the relative sliding capacity between upper and lower curved surfaces on the locked position while the walls of the curved connector maintain the relative displacement constraint in the three Cartesian axes. Finally, in FIG. 4*g* it can be seen that the locking notch (25*a*) is delimited by a protuberance that separates said notch from the passage of the curved connector where the size of said protuberance is such that it ensures requiring a pressure fit between the curved connector (20) and the floor module, said pressure fit given by the contact between the protuberance of the locking notch (25*a*) and the locking projection (17*b*) when the curved connector (20) is inserted.

According to the preferred embodiment shown in FIGS. 4*a-g*, the curved connector (20) has a semicircular appearance, as the lower and upper curved surfaces (16, 17).

Support Coupling Structure

Figure 5A:
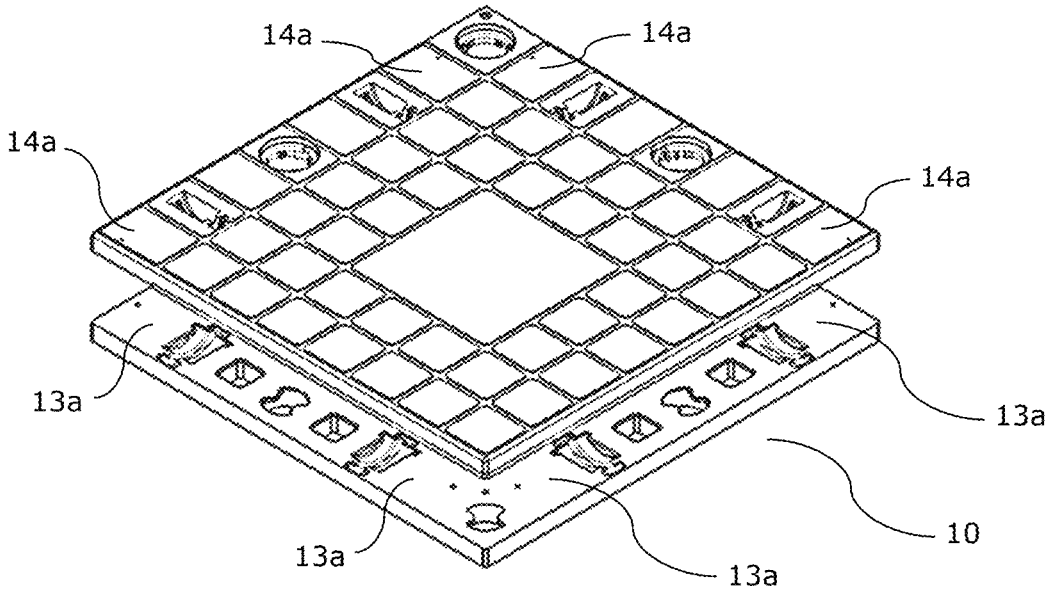
FIG. 5*a* shows a perspective view of a floor module according to a preferred embodiment of the invention, highlighting the upper and lower support surfaces.
Figure 5B:
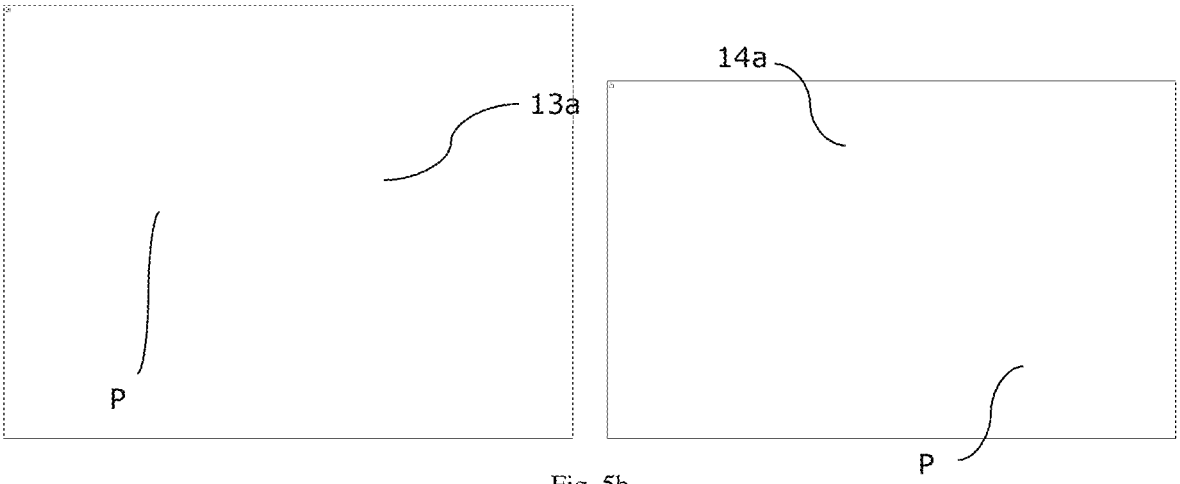
FIG. 5*b* shows perspective views of the upper and lower support surfaces separately.
Figure 5C:
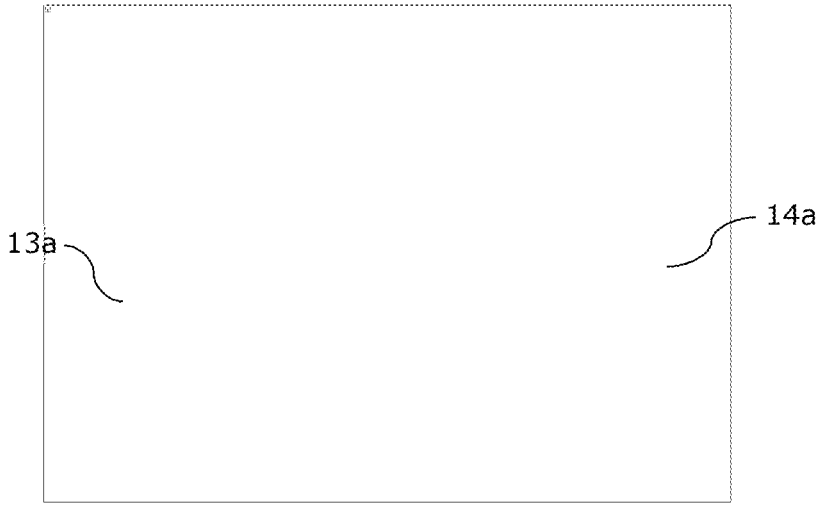
FIG. 5*c* shows a perspective view of the coupled upper and lower support surfaces.

FIGS. 5*a-c* shows the support coupling structure that the invention can implement, according to a preferred embodiment. Said support coupling structure is formed by at least one lower support surface (13*a*) formed in the lower perimeter overlapping area (13) and at least one upper support surface (14*a*) formed in the upper perimeter overlapping area (14) of each floor module. As shown in FIG. 5*a*, each floor module (10) comprises two support surfaces for each edge of the module in its preferred embodiment.

FIG. 5*b* shows perspective views of the lower support surface (13*a*) and of the lower support surface (13*b*), as an example, being possible to appreciate that they are not only configured to generate a support coupling between modules (see FIG. 5*c*), but can also provide smooth surfaces that are useful for commercial use and even incorporate fixing means between modules. In the latter case, screws can be implemented as fixing elements which fix two coupled modules through the fixing holes (P) that said support surfaces have, taking advantage of contact surfaces between modules.

FIG. 5*c* shows the coupling of the lower and upper support surfaces (13*a*, 13*b*) generating the support area between coupled floor modules. Preferably, when a floor module is coupled to four adjacent floor modules, said floor module has at least eight support areas where the lower and upper support surfaces of adjacent modules come into contact and distribute the loads among themselves.

Fitting Coupling Structure

Figure 6A:
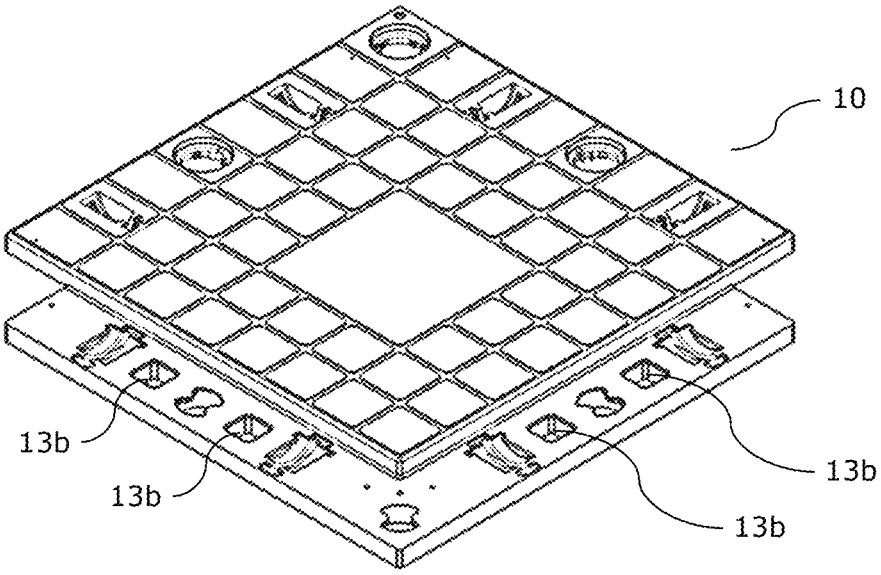
FIG. 6*a* shows a perspective view of a floor module according to a preferred embodiment of the invention, highlighting the fitting holes and projections.

FIGS. 6*a-d* show preferred configurations of the fitting coupling structure that the invention has, formed by fitting holes (13*b*), arranged in the lower overlapping area of each module, and fitting projections (14*b*) arranged in the upper overlapping area. In FIG. 6*a* it can be appreciated the arrangement of four fitting holes (13*b*) in the lower overlapping area, and the location of four fitting projections (14*b*) in the upper overlapping area stands out, not being able to see said fitting projections in FIG. 6*a* as they are projected towards the lower face of the floor module (10).

Figure 6B:
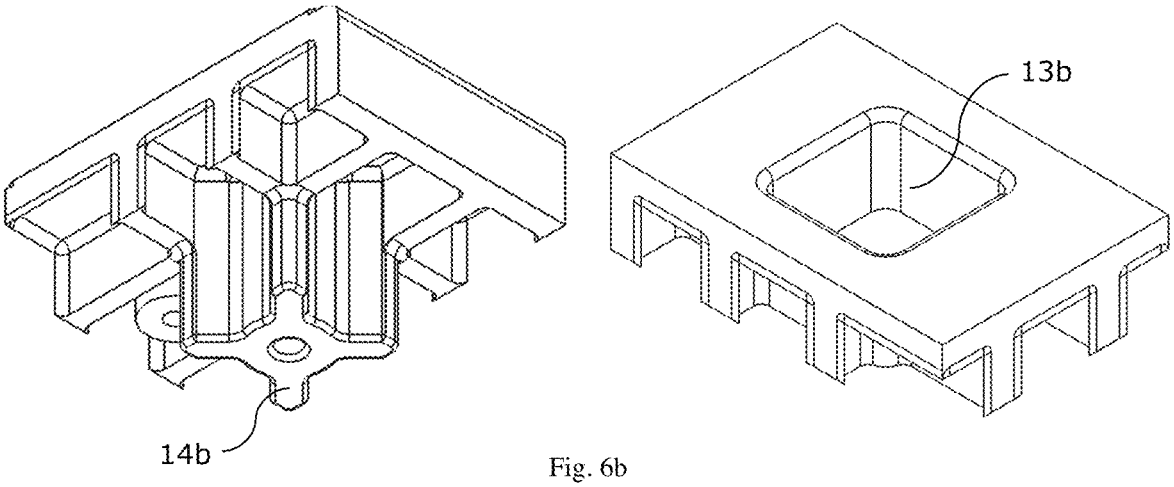
FIG. 6*b* shows perspective views of the fitting projection and the fitting hole, separately.
Figure 6C:
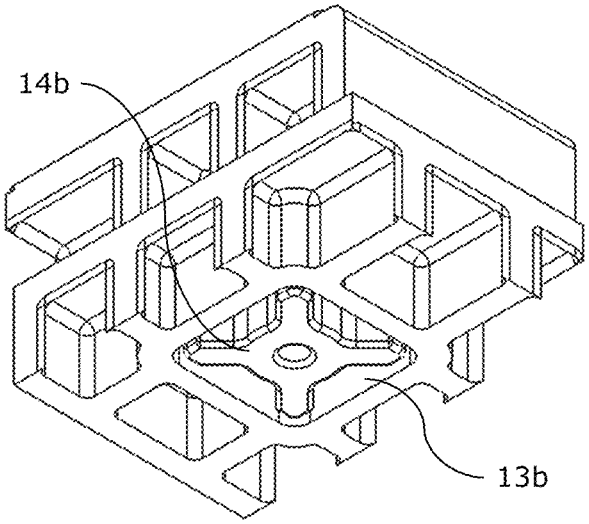
FIG. 6*c* shows a perspective view of the fitting projection coupled to the fitting hole.

In this context, FIG. 6*b* shows perspective views of the fitting projection (14*b*) and the fitting hole (14*a*), preferably formed by a robust structure with a quadrangular appearance, where when the floor modules are coupled, the at least one fitting hole (13*b*) is configured to receive the at least one fitting projection (14*b*) of the coupled floor modules as shown in FIG. 6*c*. The purpose of the fitting coupling structure is to provide strength to the lateral movements of the floor. It is a robust structure considered to be the one that works the most and supports lateral forces on the joint between floor modules.

Preferably, the upper section consists of an fitting projection (14*b*) with a cubic section (male connector) that is inserted into the lower section (or female connector) forming the coupling. Both the male connector and the female connector have a bundle of nerves around them that increases the strength of the coupling structure.

Figure 6D:
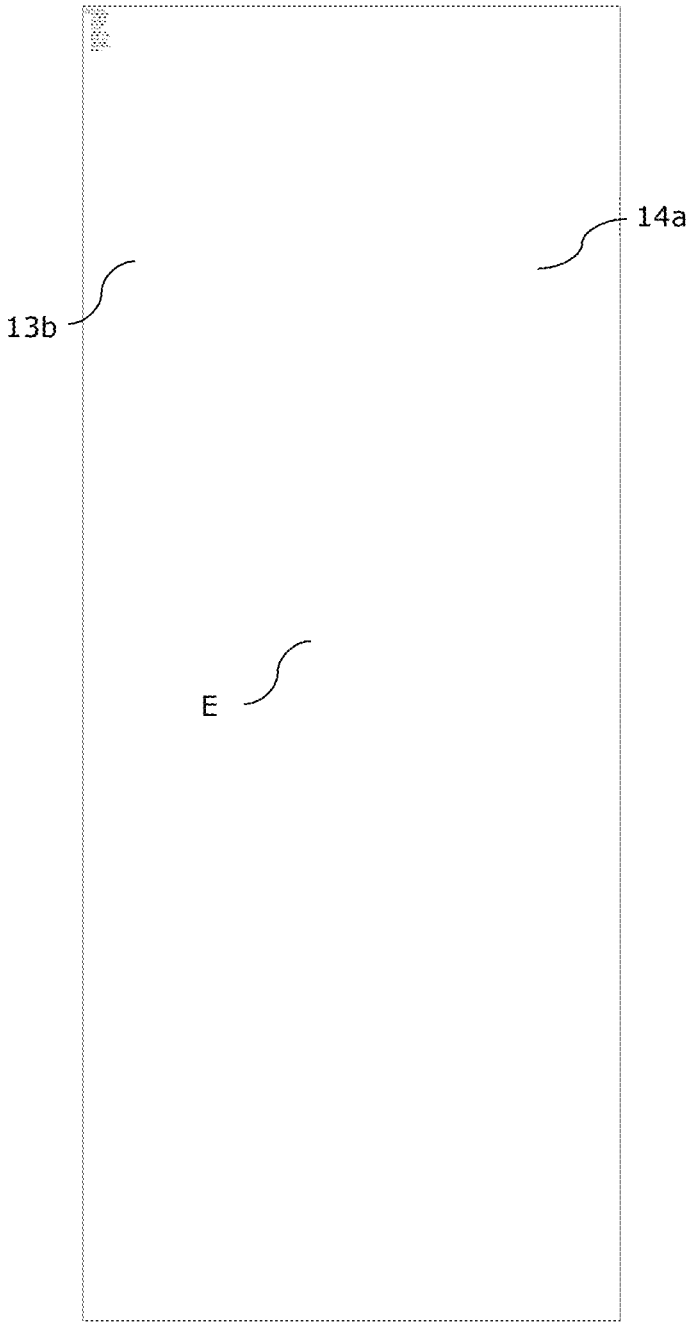
FIG. 6*d* shows a perspective view of the fitting projection coupled to the fitting hole including a stake.

Additionally, the fitting projection (14*b*) can be hollow in its center, facilitating that after drilling, stakes (E) can be inserted to generate anchoring of floor modules attached to the ground. In this embodiment, the upper surface of the fitting projection (14*b*) may comprise a cross mark indicating where the perforation is made so that it fits with the hole of the fitting projection (14*b*) and, at the same time, with the center of the fitting hole (13*b*). FIG. 6*d* shows an embodiment of an installed fitting coupling structure with stake (E).

Rotating Coupling Structure

FIGS. 7*a-e* show configurations of the rotating coupling structure formed by the connection of a rotating connector (30) with a lower locking hole (13*c*) and an upper locking hole (14*c*) arranged in adjacent floor modules. According to FIG. 7*a*, a preferred embodiment of the invention comprises six locking holes in total, three upper locking holes (14*c*) arranged in the upper overlapping area, and three lower locking holes (13*c*) arranged in the lower overlapping area.

As indicated, a rotating connector (30) is inserted into the upper and lower locking holes and, by rotating it, said rotating connector locks the relative vertical movement between coupled floor modules in a locking position of the rotating connector. According to the preferred embodiment, when the rotating connector (30) is rotated towards its locking position, it is inseparably joined to the upper locking hole (14*c*), preventing the rotating connector from being lost during assembly and disassembly operations of the modular floor (see FIG. 7*b*). Said characteristic of inseparable union between the rotating connector (30) and the upper locking hole (14*c*) does not prevent the rotating connector (30) from allowing the releasable locking of the lower locking hole (13*c*) when two floor modules are coupled (see FIG. 7*c*). In effect, both characteristics are complementary and are obtained by configuring different sections in the upper and lower locking holes which interact with the rotating connector (30) during its operation.

Figure 7A:
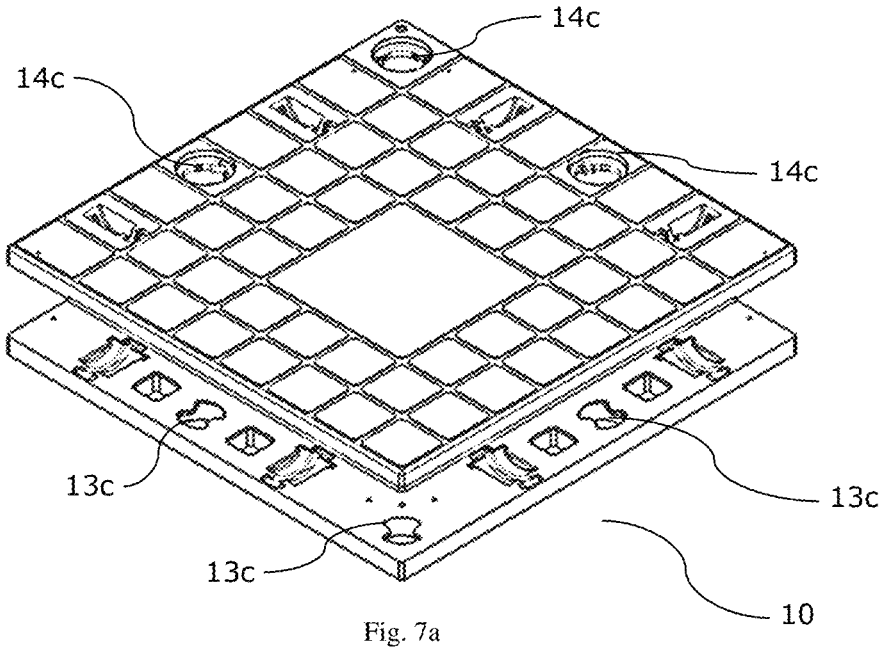
FIG. 7*a* shows a perspective view of a floor module according to a preferred embodiment of the invention, highlighting the upper and lower locking holes.
Figure 7B:
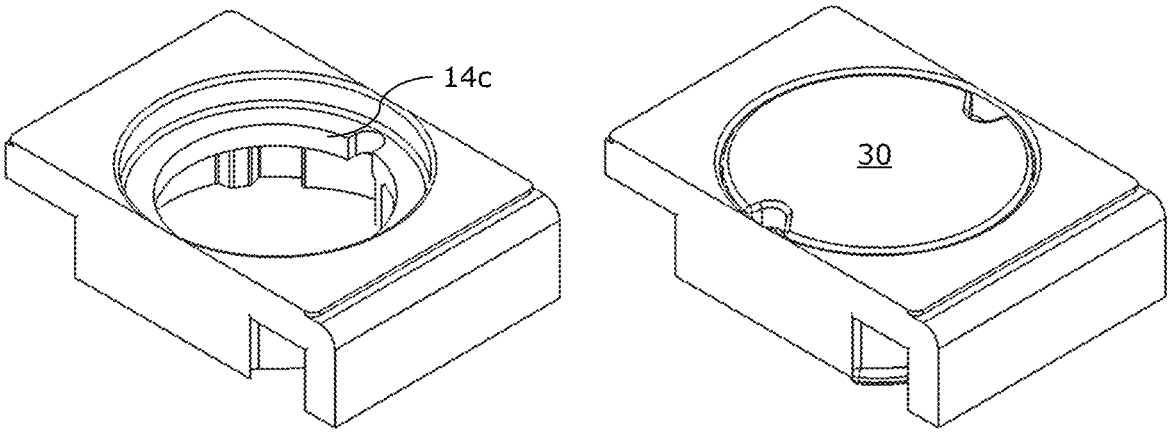
FIG. 7*b* shows perspective views of the upper locking hole with and without the rotating connector.
Figure 7C:
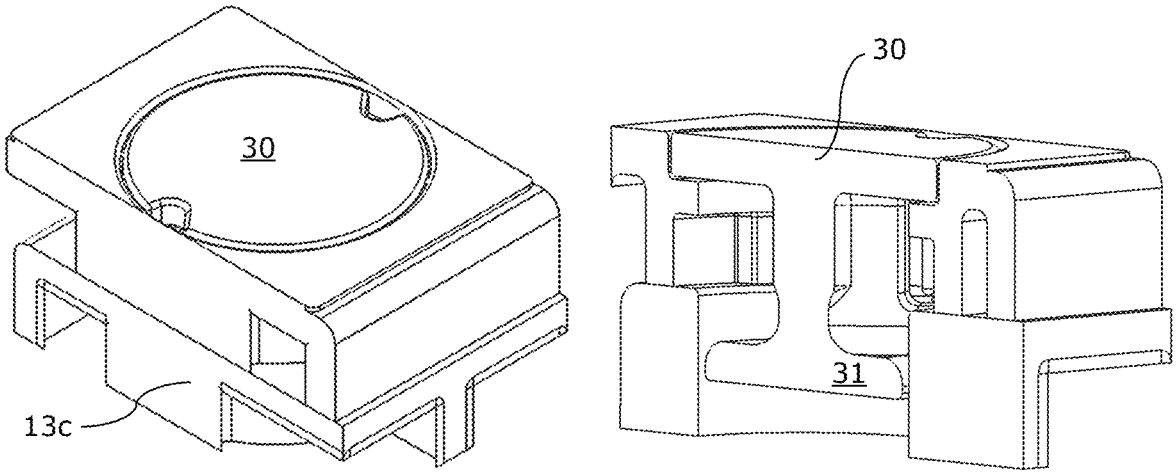
FIG. 7*c* shows perspective and sectional views of the rotating connector connected in the upper and lower locking holes.

In this context, FIG. 7*c* shows a rotating connector (30) in its locking position, wherein a locking element (31) of the rotating connector (30) comes into contact by pressure with a lower locking section of the lower locking hole (13*c*). Said pressure contact allows to obtain a pressure rotating joint effect which increases the strength of the joint with the rotation of the connector.

Figure 7D:
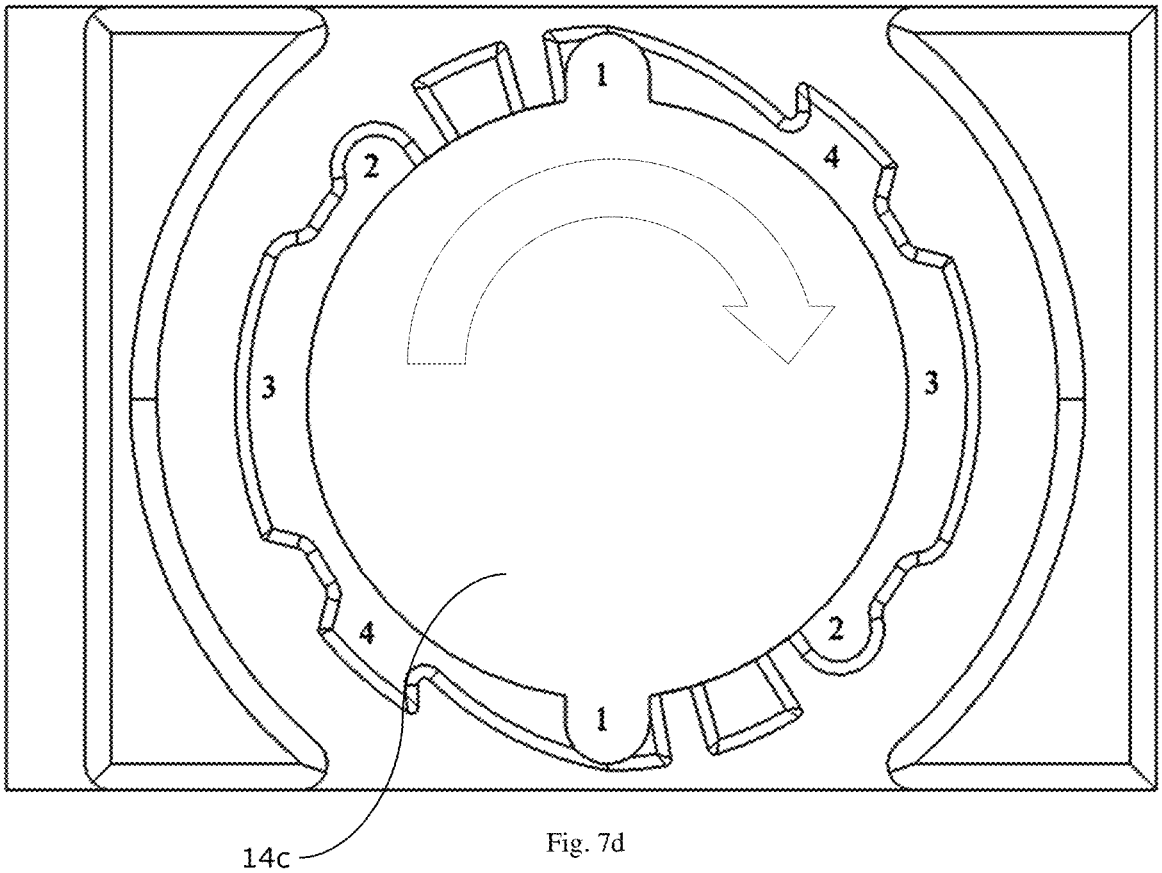
FIG. 7*d* shows a bottom view of the upper locking hole, where the insertion, upper locking, transition and upper unlocking sections can be seen.
Figure 7E:
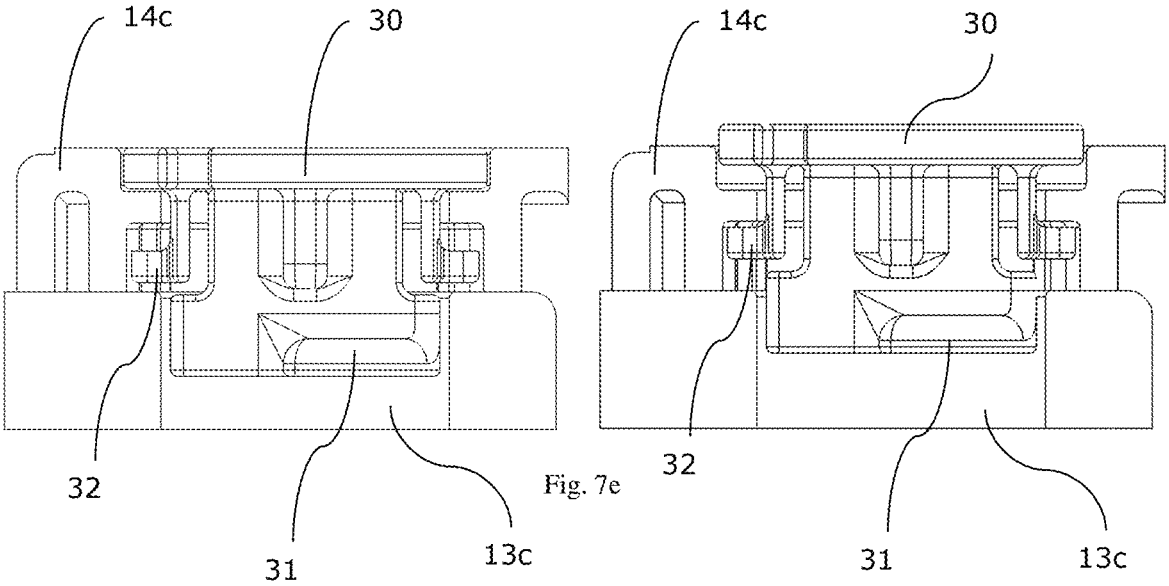
FIG. 7*e* shows sectional views of the rotating connector connected in the upper and lower locking holes.

On the other hand, FIG. 7*d* shows different sections on the lower face of the upper locking hole (14*c*), which are arranged in the form of fitting notches and fitting flanges as pressure fit mechanisms, which interact with at least a pressure fit projection (32) comprising the rotating connector (see FIG. 7*e*). Specifically, FIG. 7*d* shows the detail of the design of the lower face of the upper locking hole (14*c*) which is intended to allow the insertion of the rotating connector (30) and keep it permanently attached to the upper locking hole (14*c*) by rotating in the direction of the arrow shown in FIG. 7*d*. It is a symmetrical design that preferably considers four operating sections:

1) Section No. 1 or insertion section is where the rotating connector is inserted. This section is only used once, since when turning the rotating connector and moving to section No. 4, it can never return to Section No. 1 to be removed.

2) Section No. 2 or upper unlocking section, is the open position section. In this position the upper and lower locking holes are not joined, and the floor modules can be decoupled.

3) Section No. 3 or transition section, is the connector path section. As the rotating connector rotates and travels through this section, the coupling between the upper and lower holes begins to lock on its vertical axis.

4) Section No. 4 is the upper locking section. In this position the upper and lower locking holes are locked, the upper locking section fitting with the lower locking section of the lower locking hole. It should be noted that, both to exit and enter sections No. 2 and No. 4, a force is applied that exceeds the pressure fit force, since there is interaction between fitting notches and flanges in the floor modules with pressure fit projections on the rotating connector which narrows the path and forces the pressure fit projections on the connector to activate. The fitting flange of Section No. 4 (closed position) is larger, which means that a greater force (torque) is applied to enter and exit this position compared to Section No. 2 (open position).

Through the previous configuration it is possible to see that the rotating connector (30) can move from section No. 1 to No. 4 and, from said position, move freely exceeding the pressure fits between sections No. 2, 3 and 4. As noted, the design of the embodiment prevents the rotating connector from returning to section No. 1.

By way of example, FIG. 7*e* shows the configuration of the pressure fit projections (32) comprising the rotating connector (30). Furthermore, it is appreciated that the design of the rotating connector (30) may allow a small vertical displacement within the upper locking hole (14*c*) of a floor module. This allows the rotating connector to better resist bumps and imperfections when trying to couple and fastening one module to another.

Module Cover

Figure 8A:
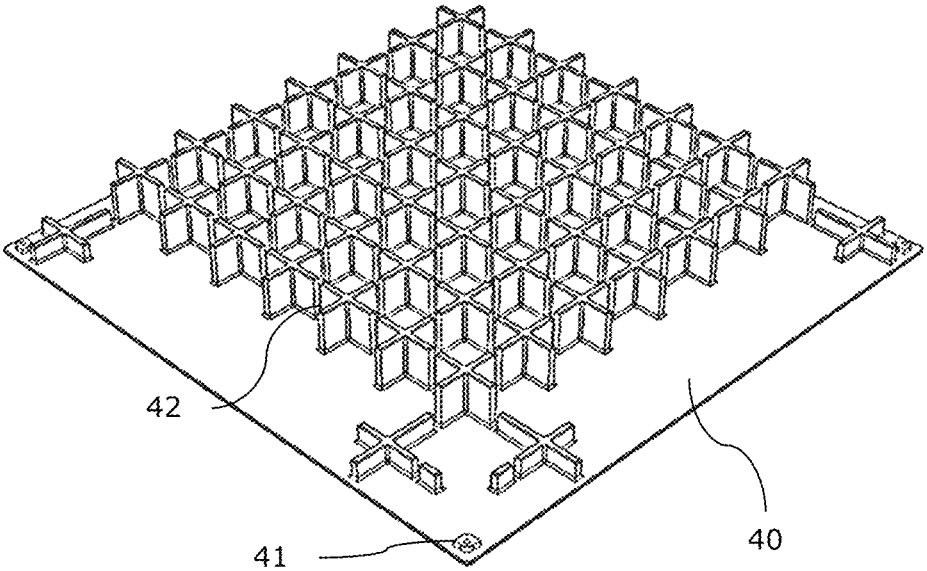
FIG. 8*a* shows a perspective view of a floor module cover according to one embodiment of the invention.
Figure 8B:
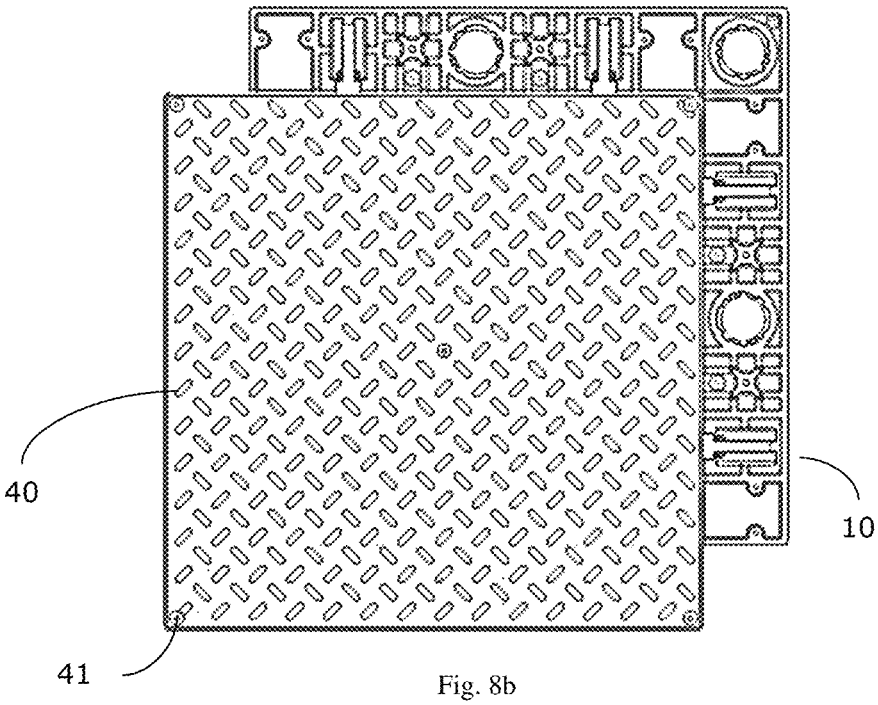
FIG. 8*b* shows a bottom view of a floor module with a cover according to one embodiment of the invention.
Figure 8C:
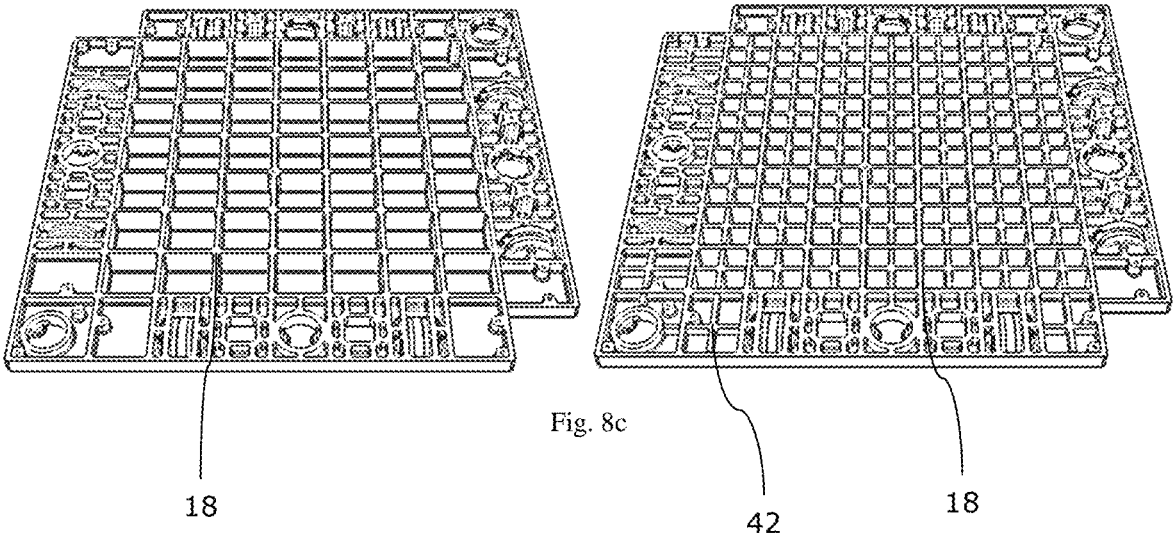
FIG. 8*c* shows perspective views of the grid configuration of a floor module with and without a cover.

Although it is outside the coupling structures proposed by the invention, an alternative of this comprises a module cover (40) as shown in FIGS. 8*a-c*. Said Figures show a floor module design that implements a cover (40) which connects to the lower face of the lower portion of the floor module body (10). Said cover (40) shown in FIG. 8*a*, is attached to the floor module (10) as shown in FIG. 8*b*, completely fitting with the lower portion that comes into contact with the ground during the operation of the modular floor. Said cover can be fastened to the floor module body (10) by means of one or more fixing elements (41) such as screws, preferably, four screws in the corners of the cover (40) and one in the center with the corresponding perforations both in the cover and on the lower side of the floor module.

Alternatively, the cover comprises a cover grid (42) that when assembling the cover (40) with the floor module (10), fits with a floor module grid (18) arranged on the lower side of said lower portion of the floor module (10), as shown in FIG. 8*c* where the cover is represented only by the cover grids (42). Particularly, the design of the cover (40) consists of a grid of cross-shaped nerves that fit exactly with the lower square grid of the floor module (10). This practically doubles the support points of the floor. Then, by fitting both grids (of the cover and the module) a reinforced lower grid configuration is obtained, which increases the compression strength of the floor module.

Figure 9:
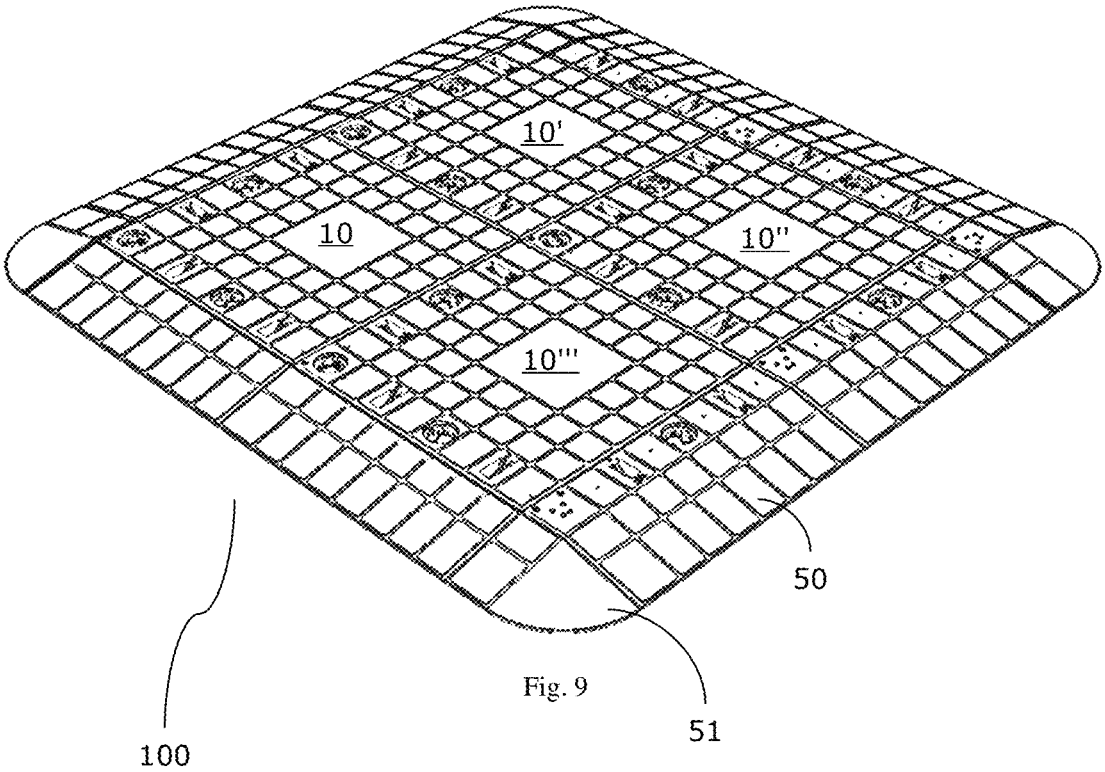
FIG. 9 shows a perspective view of the modular floor according to a preferred embodiment of the invention.

Finally, in FIG. 9 an exemplary configuration of the modular floor (100) can be seen, formed by four floor modules (10, 10', 10", 10'") coupled together, wherein the perimeter of the modular floor comprises perimeter ramp sections (50) that are coupled to the lower or upper overlapping areas that are free after the coupling of the floor modules. Said ramp sections can be complemented with, or integrated into, corner sections (51) which configure a soft and uniform modular floor perimeter which reduces discontinuities with the floor where it is installed.

The invention claimed is:

1. A curved connector for flexibly fastening coupled floor modules together, wherein the curved connector is formed from a single-piece body comprising a perimeter curved portion and a central curved portion;

wherein, between the perimeter curved portion and the central curved portion there is at least one passage that has curved walls formed by the perimeter curved and central curved portions, an inlet end and a locking end, said locking end comprising a locking mechanism;

wherein the at least one passage is configured to receive therein an upper curved surface coupled to a lower curved surface of coupled floor modules, so that the curved walls of the at least one passage flexibly restrain a relative movement between the coupled floor modules in three Cartesian axes, generating a flexible coupling between the coupled floor modules;

wherein, to flexibly restrict said relative movement the curved connector locks the coupling between upper and lower curved surfaces by means of a rotation movement thereof through a curved connector slot that said upper and lower curved surfaces have, so that the at least one passage receives said coupled upper and lower curved surfaces, and the coupled upper and lower curved surfaces enter the at least one passage from the inlet end and slide through said at least one passage to the locking end, activating the locking mechanism in a flexible locking position of the curved connector;

wherein, in the flexible locking position of the curved connector, the at least one passage comprises a locking space that allows relative sliding between the coupled upper and lower curved surfaces, locking the curved connector in the flexible locking position of the curved connector and flexibly fastening the coupled floor modules together.

2. The curved connector of claim 1, wherein the locking mechanism comprises a locking flange and a locking notch inside the at least one passage at the locking end, wherein said locking notch is configured to receive, by pressure fit, a locking projection arranged on the upper curved surface, locking the curved connector in the flexible locking position by said pressure fit activating the locking mechanism.

3. The curved connector of claim 1, wherein the at least one passage comprises a fixing mechanism arranged at the inlet end, wherein said fixing mechanism is configured to contact at least one of the floor modules coupled in the locking position of the curved connector, and to receive a releasable fastening element that releasably fixes the curved connector to the at least one of the floor modules.

4. The curved connector of claim 1, wherein the central curved portion comprises a flat surface comprising at least one unlocking notch, said unlocking notch configured to receive an unlocking tool that allows deactivating the locking mechanism by a rotation movement of the curved connector towards an unlocking position of the curved connector.

5. A floor module for forming a modular floor of two or more coupled floor modules flexibly fastened together, wherein the floor module is formed from a single-piece body comprising a lower portion and an upper portion, wherein the upper and lower portions are arranged relative to each other, generating perimeter overlapping areas;

wherein, a lower perimeter overlapping area is arranged in the lower portion of the body and an upper perimeter overlapping area is arranged in the upper portion of the body;

wherein, the upper overlapping area comprises at least one upper curved surface and the lower overlapping area comprises at least one lower curved surface, said at least one upper curved surface and at least one lower curved surface comprising a curved connector slot;

wherein the at least one upper curved surface is configured to couple to the at least one lower curved surface of coupled floor modules, and by means of a curved connector of claim 1, a relative movement between the coupled floor modules is flexibly constrained in three Cartesian axes generating a flexible coupling between the coupled floor modules, wherein said curved connector locks the coupling between upper and lower curved surfaces by a movement of rotation thereof through the curved connector slot, so that the at least one passage of the curved connector receives said coupled upper and lower curved surfaces, and the coupled upper and lower curved surfaces enter the at least one passage from the inlet end and slide through from said at least one passage to the locking end, activating the locking mechanism of the curved connector, locking the curved connector in a flexible locking position of the curved connector;

wherein, in the flexible locking position of the curved connector, the at least one passage comprises a locking space that allows relative sliding between the coupled upper and lower curved surfaces, locking the curved connector in the flexible locking position of the curved connector and flexibly fastening the coupled floor modules together.

6. The floor module of claim 5, comprising at least four lower curved surfaces in the lower perimeter overlapping area and at least four upper curved surfaces in the upper perimeter overlapping area, for the arrangement of at least two curved connectors on each edge of the floor module.

7. The floor module of claim 5, comprising at least one lower support surface in the lower perimeter overlapping area and at least one upper support surface in the upper perimeter overlapping area, wherein the lower and upper support surfaces of the coupled floor modules contact each other generating at least one support area.

8. The floor module of claim 7, wherein the lower and upper support surfaces comprise at least one fixing hole for fixing the coupled floor modules by means of a fixing element, fixing said coupled floor modules at the support area.

9. The floor module of claim 5, comprising at least one fitting hole in the lower perimeter overlapping area and at least one fitting projection in the upper perimeter overlapping area, wherein the at least one fitting hole is configured to receive the at least one fitting projection of the coupled floor modules.

10. The floor module of claim 9, wherein the at least one fitting projection in the upper perimeter overlapping area is hollow and is configured to receive a stake that allows the coupled floor modules to be fixed to the ground.

11. The floor module of claim 5, comprising at least one lower locking hole in the lower perimeter overlapping area and at least one upper locking hole in the upper perimeter overlapping area, wherein the at least one lower locking hole aligns with the at least one upper locking hole of the coupled floor modules, such that said lower and upper locking holes are configured to receive a rotating connector inserted into the lower and upper locking holes and rotated to a rotating connector locking position to restrict a relative vertical movement between coupled floor modules.

12. The floor module of claim 11, wherein:

the lower locking hole comprises a lower unlocking section and a lower locking section, wherein the lower locking section comes into pressure contact with a locking element at the rotating connector, in order to lock the relative vertical movement between the floor modules coupled in the rotating connector locking position; and the upper locking hole comprises, in the direction of the rotating connector rotation:

an insertion section for inserting the rotating connector into the upper locking hole;

an upper locking section that fits with the lower locking section and with the locking position of the rotating connector, wherein the upper locking section further prevents return of the rotating connector to the insertion section permanently joining the rotating connector with the upper locking hole;

a transition section where the pressure contact between the locking element of the rotating connector and the lower locking section is gradually released; and an upper release section that fits in the lower release section where the coupled floor modules can be decoupled;

wherein the movement of the rotating connector between the upper locking section, the transition section and the upper unlocking section can be carried out in a locking direction and in an unlocking direction by means of pressure fit mechanisms located between said sections, wherein the rotating connector comprises at least one pressure fit projection cooperating with pressure fitting flanges and fitting notches in the upper locking hole.

13. The floor module of claim 5, comprising a cover that connects to the lower face of the lower portion of the floor module body, wherein said cover comprises a cover grid that fits with a floor module grid arranged on the lower face of said lower portion of the floor module, wherein said cover comprises a slotted lower face for contact with the ground, and wherein said cover and said lower face comprise at least one perforation to receive a fixing element that fixes the cover to the floor module body.

14. A modular floor formed by two or more coupled floor modules flexibly fastened to each other, comprising:

at least one curved connector of claim 1; and two or more floor modules; and wherein each floor module is formed from a single-piece body comprising a lower portion and an upper portion, wherein the upper and lower portions are arranged relative to each other, generating perimeter overlapping areas;

wherein, a lower perimeter overlapping area is arranged in the lower portion of the body and an upper perimeter overlapping area is arranged in the upper portion of the body;

wherein, the upper overlapping area comprises at least one upper curved surface and the lower overlapping area comprises at least one lower curved surface, said at least one upper curved surface and at least one lower curved surface comprising a curved connector slot;

wherein the at least one upper curved surface is configured to couple to the at least one lower curved surface of the coupled floor modules, and by means of a curved connector of claim 1, a relative movement between the coupled floor modules is flexibly constrained in three Cartesian axes generating a flexible coupling between the coupled floor modules, wherein said curved connector locks the coupling between upper and lower curved surfaces by a movement of rotation thereof through the curved connector slot, so that the at least one passage of the curved connector receives said coupled upper and lower curved surfaces, and the coupled upper and lower curved surfaces enter the at least one passage from the inlet end and slide through from said at least one passage to the locking end, activating the locking mechanism of the curved connector, locking the curved connector in a flexible locking position of the curved connector;

wherein, in the flexible locking position of the curved connector, the at least one passage comprises a locking space that allows relative sliding between the coupled upper and lower curved surfaces, locking the curved connector in the flexible locking position of the curved connector and flexibly fastening the coupled floor modules together;

wherein at least part of the upper perimeter overlapping area of a first floor module is coupled to at least part of the lower perimeter overlapping area of a second floor module, so that at least one upper curved surface of the first floor module couples with at least one lower curved surface of the second floor module, resulting in the coupling of the first floor module with the second floor module;

wherein the coupling between the at least one upper curved surface and the at least one lower curved surface is locked by a rotation movement of the curved connector through a curved connector slot that said upper and lower curved surfaces have, so that the at least one passage of the curved connector receives said coupled upper and lower curved surfaces, and the coupled upper and lower curved surfaces enter the at least one passage from the inlet end and slide through said at least one passage to the locking end, activating the locking mechanism in a flexible locking position of the curved connector, so that the curved walls of the at least one passage flexibly restrict a relative movement between the floor modules coupled in three Cartesian axes generating a flexible coupling between the coupled floor modules;

wherein, in the flexible locking position of the curved connector, the at least one passage comprises a locking space that allows relative sliding between the coupled upper and lower curved surfaces, locking the curved connector in the locking position of the curved connector and flexibly fastening the coupled floor modules to each other.

15. The modular floor of claim 14, comprising at least one rotating connector that is received in lower and upper locking holes of the coupled floor modules, wherein the rotating connector is inserted into the upper and lower locking holes and is rotated to a locking position of the rotating connector to restrict a relative vertical movement between coupled floor modules.

16. The modular floor of claim 14, comprising perimeter ramp sections, wherein said perimeter ramp sections comprise:

a ramp lower overlapping area configured to couple to the upper perimeter overlapping area of a floor module; or a ramp upper overlapping area configured to couple to the lower perimeter overlapping area of a floor module; and, wherein the modular floor also comprises corner sections that are part of the corner perimeter ramp sections comprising a single-piece body, or that are independent of the perimeter ramp sections.

* * * * *